US012043928B2

(12) United States Patent
Li

(10) Patent No.: US 12,043,928 B2
(45) Date of Patent: Jul. 23, 2024

(54) WEAVING METHOD FOR CLOSING WEBBING EDGES

(71) Applicant: HING MAN (LEE'S) CO., LTD., Hong Kong (HK)

(72) Inventor: Junhui Li, Hong Kong (CN)

(73) Assignee: HING MAN (LEE'S) CO., LTD., Hong Kong (HK)

( * ) Notice: Subject to any disclaimer, the term of this patent is extended or adjusted under 35 U.S.C. 154(b) by 68 days.

(21) Appl. No.: 17/737,961

(22) Filed: May 5, 2022

(65) Prior Publication Data

US 2022/0290341 A1 Sep. 15, 2022

Related U.S. Application Data

(63) Continuation of application No. PCT/CN2020/107834, filed on Aug. 7, 2020.

(30) Foreign Application Priority Data

Nov. 11, 2019 (CN) ..... 201911094836.1

(51) Int. Cl.
*D03D 5/00* (2006.01)
*D03D 13/00* (2006.01)
*D03D 25/00* (2006.01)

(52) U.S. Cl.
CPC ..... *D03D 13/004* (2013.01)

(58) Field of Classification Search
CPC ..... D03D 13/004; D03D 3/005; D03D 5/00; D03D 1/0094
See application file for complete search history.

(56) References Cited

U.S. PATENT DOCUMENTS 37,546 A * 1/1863 Goullioud ..... D03D 35/00 139/117
1,037,752 A * 9/1912 Gaynor ..... A41B 7/00 139/117
1,622,542 A * 3/1927 Renshaw ..... D03D 35/00 139/18

(Continued)

FOREIGN PATENT DOCUMENTS

CN 1662692 A 8/2015
CN 207619590 U 7/2018

(Continued)

OTHER PUBLICATIONS

Braid. (n.d.) American Heritage® Dictionary of the English Language, Fifth Edition. (2011). Retrieved May 7, 2024 from https://www.thefreedictionary.com/braid (Year: 2011).*

*Primary Examiner* — Robert H Muromoto, Jr.

(57) ABSTRACT

A weaving method for braid edge overlock includes: first fore-and-back trip, second fore-and-back trip, third fore-and-back trip and fourth fore-and-back trip. The tissue form of the braid edge in the present application includes sinking lock sites and floating lock sites, and the structure of two side edges of the braid enables the sinking and floating of the upper and lower layers misalign properly, forming misaligned positions of warp yarns so as to make the weft yarn weave pair locks, which makes the structures of the left and right edges of the braid form shaggy, fluffy and soft round corners, so as to not scratch when contacting with the skins, and wear more comfortably.

2 Claims, 10 Drawing Sheets

(56) References Cited

U.S. PATENT DOCUMENTS 3,177,873 A * 4/1965 Jamison ..... A61F 13/49003 139/383 R
3,952,778 A * 4/1976 Volpe ..... D03C 7/06 139/54
4,007,763 A * 2/1977 Sellers ..... D03D 47/38 139/432
4,018,960 A * 4/1977 Berger ..... D03D 11/00 428/36.1
4,344,463 A * 8/1982 Muller ..... D03D 47/06 139/117
4,421,142 A * 12/1983 Muller ..... D03D 47/42 139/117
4,481,981 A * 11/1984 Motte ..... B60R 22/12 139/426 R
4,660,605 A * 4/1987 Koch ..... D03D 1/0005 139/117
4,750,529 A * 6/1988 Watanabe ..... D03C 15/00 428/193
4,800,929 A * 1/1989 Watanabe ..... D03D 47/40 428/193
4,894,276 A * 1/1990 Bryant ..... D06B 15/085 139/50
4,981,161 A * 1/1991 Pickering ..... D03D 1/0005 139/432
5,167,263 A * 12/1992 Kelen ..... D03D 47/44 139/408
5,299,603 A * 4/1994 Reiter ..... D03D 47/02 139/22
5,419,951 A * 5/1995 Golz ..... B66C 1/18 139/411
5,635,270 A * 6/1997 Fletcher ..... D03D 47/50 428/102
5,769,130 A * 6/1998 Brielmann ..... D03D 13/004 139/22
5,979,135 A * 11/1999 Reeves ..... E04F 13/18 139/50
6,085,802 A * 7/2000 Silberberg ..... D03D 1/0005 139/387 R
6,112,775 A * 9/2000 Hossli ..... D03D 35/00 139/432
6,164,692 A * 12/2000 Takeuchi ..... D03D 1/02 280/733
6,199,597 B1 * 3/2001 David ..... D03D 1/0005 139/22
6,260,926 B1 * 7/2001 Meraw ..... B60R 22/16 280/805
6,705,244 B1 * 3/2004 Berger ..... D03D 1/0005 139/389
7,004,205 B2 * 2/2006 Baudonnel ..... D03D 15/283 139/384 R
7,178,559 B2 * 2/2007 Tielemans ..... D06C 7/02 139/117
7,252,129 B2 * 8/2007 Michiels ..... B60C 9/2204 152/533
7,380,573 B2 * 6/2008 Reiter ..... D04B 21/10 139/432
7,451,787 B2 * 11/2008 Speich ..... D03D 35/00 139/281
7,721,518 B2 * 5/2010 Danzey ..... D03D 15/587 57/210
7,743,794 B2 * 6/2010 Berger ..... D03D 1/0005 139/432
7,750,200 B2 * 7/2010 Leuprecht ..... D03D 15/56 602/76
7,780,194 B2 * 8/2010 Trondle ..... D03D 1/02 442/76
7,857,012 B2 * 12/2010 Speich ..... D03D 47/06 139/22
7,874,335 B2 * 1/2011 Michiels ..... B60C 9/2204 152/533
7,992,611 B2 * 8/2011 Imhoff ..... D03D 13/008 152/542
8,137,779 B2 * 3/2012 Russell ..... D03D 11/02 428/36.1
8,163,362 B2 * 4/2012 Russell ..... D03D 15/43 428/36.1
8,459,871 B2 * 6/2013 Samadijavan ..... D03D 5/00 428/36.1
8,763,649 B2 * 7/2014 Becker ..... D03D 3/00 442/76
8,893,750 B2 * 11/2014 Hockemeyer ..... D03D 19/00 139/50
8,925,592 B2 * 1/2015 Itoh ..... D03D 3/08 138/123
9,085,834 B2 * 7/2015 Huber ..... D03D 13/008
9,328,436 B2 * 5/2016 Russell ..... A62B 35/0093
10,702,723 B2 * 7/2020 Quigley ..... B60R 22/28
10,799,731 B2 * 10/2020 Jacob ..... A62B 35/04
2002/0189701 A1 * 12/2002 Berger ..... D03D 47/44 139/383 R
2006/0185778 A1 * 8/2006 Michiels ..... B60C 9/22 152/533
2006/0185779 A1 * 8/2006 Michiels ..... B60C 9/2204 152/533
2007/0267119 A1 * 11/2007 Michiels ..... B60C 9/2204 152/533
2009/0062712 A1 * 3/2009 Leuprecht ..... D03D 13/006 602/44
2010/0065179 A1 * 3/2010 Imhoff ..... B60C 15/00 152/526
2013/0333794 A1 * 12/2013 Hockemeyer ..... D03C 7/06 139/50
2022/0290341 A1 * 9/2022 Li ..... D03D 3/005

FOREIGN PATENT DOCUMENTS

DE 102004015327 A1 4/2005
JP 2004324011 A 11/2004

* cited by examiner

WEAVING METHOD FOR CLOSING WEBBING EDGES

The present application claims priority to the Application No. 201911094836.1, entitled "A Weaving Method for Braid Edge Overlock", filed to China National Intellectual Property Administration on Nov. 11, 2019, the entire contents of which are incorporated in the present application by citing.

TECHNICAL FIELD

The present application relates to different type of elastics included shoulder straps, waistband, under bust and fold over elastics all use for underwear, swimwear and sportswear, and in particular to a weaving method for braid edge overlock.

BACKGROUND

The braid is typically interwoven at regular intervals by warp yarns and weft yarns, which is widely used in the garment industry, especially in shoulder straps, waistband, under bust and fold over elastics all use for underwear, swimwear, and sportswear. Currently, the market is focused on the appearance decorations of shoulder straps, waistband, under bust and fold over elastics all use for underwear, swimwear, and sportswear, but ignores the comfort of wearing.

In the prior art, the edges of shoulder straps, waistband, under bust or fold over elastics use for use a common and simple edge process, as shown in FIG. 8 (only two radial lines of the left and right edges are shown in FIG. 8), i. e., the weft 1 is required to bypass the warp at the edge position (overlock position) at each switch-back stroke, and the tissue structure at the edge position is shown in FIG. 9. The use of this common and simple edge process results in the weft 1 being sufficiently exposed to the warp at the edge position (overlock position), making the left and right edges of shoulder straps, waistband, under bust or fold over elastics solid and sharp so that the edges scratch, which results in wearing extremely uncomfortably. As the increasing pursuit of the comfort levels for underwear, swimwear, and sportswear by females, there is a need for improvements in the present technology.

SUMMARY

In order to overcome the deficiencies of the prior art, the object of the present application is to provide a weaving method for braid edge overlock that enables the braid edge portion shaggier and fluffier.

The embodiment of the present application provides a weaving method for braid edge overlock, to weave two side edges of the braid, herein a single side edge of the braid includes a plurality of warp yarns and at least one weft yarn; the warp yarns alternately move upward and downward, thereby forming upper and lower layers; the weft yarn shuttles left and right between the upper and lower layers of the warp yarns, thereby forming the braid edges by interweaving with the warp yarns; either of the left and right edges of the braid includes at least four warp yarns, referred to as Warp A, B, C, D from left to right; the right edge of the braid is provided with a right side yarn. The weaving processes include:

First Fore and Back Trips:

The fore trip of the weft at the left edge: Warp A, B, D move downward, the weft shuttles over Warp A, B, D from left to right, and, Warp C moves upward, the weft shuttles under Warp C from left to right and then reach the right edge, and in the fore trip of the weft at the left edge, Warp A and the weft interweave and lock with each other at Warp A; The fore trip of the weft at the right edge: Warp A, B, D move downward, the weft shuttles over Warp A, B, D from left to right, and, Warp C moves upward, the weft shuttles under Warp C from left to right and then lock with the right side yarn, and in the fore trip of the weft at the right edge, Warp A and the weft interweave and lock with each other at Warp A;

The back trip of the weft: the weft returns along the way of the fore trip, and in the process of the weft return, Warp A, B, C, D remain motionless, and the tissue form formed by the first fore-and-back trip is referred to as three-sinking-one-floating;

Second Fore-and-Back Trip:

The fore trip of the weft at the left edge: Warp A, B, C move upward, the weft shuttles under Warp A, B, C from left to right, and, Warp D moves downward, the weft shuttles over Warp D from left to right and then reach the right edge, and in the fore trip of the weft at the left edge, Warp B and the weft interweave and lock with each other at Warp B;

The fore trip of the weft at the right edge: Warp A, B, C move upward, the weft shuttles under Warp A, B, C from left to right, and, Warp D moves downward, the weft shuttles over Warp D from left to right and then lock with the right side yarn, and in the fore trip of the weft at the right edge, Warp B and the weft interweave and lock with each other at Warp B;

The back trip of the weft: the weft returns along the way of the fore trip, and in the process of the weft return, Warp A, B, C, D remain motionless, and the tissue form formed by the second fore-and-back trip is referred to as three-floating-one-sinking;

Third Fore-and-Back Trip:

The fore trip of the weft at the left edge: Warp B, C, D move downward, the weft shuttles over Warp B, C, D from left to right, and, Warp A moves upward, the weft shuttles under Warp A from left to right and then reach the right edge, and in the fore trip of the weft at the left edge, Warp C and the weft interweave and lock with each other at Warp C;

The fore trip of the weft at the right edge: Warp B, C, D move downward, the weft shuttles over Warp B, C, D from left to right, and, Warp A moves upward, the weft shuttles under Warp A from left to right and then lock with the right side yarn, and in the fore trip of the weft at the right edge, Warp C and the weft interweave and lock with each other at Warp C;

The back trip of the weft: the weft returns along the way of the fore trip, and in the process of the weft return, Warp A, B, C, D remain motionless, and the tissue form formed by the third fore-and-back trip is referred to as three-sinking-one-floating; Fourth fore-and-back trip:

The fore trip of the weft at the left edge: Warp A, C, D move upward, the weft shuttles under Warp A, C, D from left to right, and, Warp B moves downward, the weft shuttles over Warp B from left to right and then reach the right edge, and in the fore trip of the weft at the left edge, Warp D and the weft interweave and lock with each other at Warp D;

The fore trip of the weft at the right edge: Warp A, C, D move upward, the weft shuttles under Warp A, C, D from left to right, and, Warp B moves downward, the weft shuttles over Warp B from left to right and then lock with the right side yarn, and in the fore trip of the weft at the right edge, Warp D and the weft interweave and lock with each other at Warp D;

The back trip of the weft: the weft returns along the way of the fore trip, and in the process of the weft return, Warp A, B, C, D remain motionless, and the tissue form formed by the fourth fore-and-back trip is referred to as three-floating-one-sinking;

Particularly, the Warp A, B, C, D are a group, each warp yarn is independently controlled to move upward and downward, three of Warp A, B, C, D are required to move in the opposite direction of the other one, thereby forming the upper and lower layers, a group of four warp yarns in each fore-and-back trip have only one warp yarn interweaving and locking with weft yarn, thereby forming lock sites, and the lock sites of respectively four successive fore-and-back trips locate on different warp yarns, each lock site is not at the same position, thereby forming misaligned pair lock of the upper and lower layers.

Particularly, the structure may arbitrarily select the starting point to form a four-lateral-four-longitudinal structure, but the structure is required to conform to a three-sinking-one-floating or three-floating-one-sinking form.

The benefit of the present application compared to the prior art is:

The tissue form of the braid edge in the present application includes sinking lock sites and floating lock sites, and the structure of two side edges of the braid enables the sinking and floating of the upper and lower layers misalign properly, forming misaligned positions of warp yarns so as to make the weft yarn weave pair locks.

The above-described pair locks weaved by the weft yarn are able to utilize the tightness of the back trip of the weft to reduce the exposure of the weft at the overlock, thereby forming elastic band with shaggy, fluffy and soft round corners at the left and right sides that are symmetrical and have no difference in shape. Thus, the structures of the left and right edges of the braid form shaggy, fluffy and soft round corners, so as to not scratch when contacting with the skins, and wear more comfortably.

DESCRIPTION OF THE DRAWINGS

One or more embodiments are illustrated exemplarily by the figures in the accompanying drawings, and the exemplary illustrations do not constitute a limitation of the embodiments. The elements of the drawings with the same reference numeral designations are denoted as similar elements, unless otherwise stated, the figures in the drawings do not constitute a scale limitation.

In the figures: 1, the weft; 2, the right side yarn.

DETAILED DESCRIPTION OF EMBODIMENTS

In the following, the present application is further described in conjunction with the drawings and detailed embodiments. It should be noted that, on the premise of no conflict, various embodiments or various technical features described below may form new embodiments in any combination.

Referring to FIGS. 1-7, a weaving method for braid edge overlock, to weave two side edges of the braid, herein a single side edge of the braid includes a plurality of warp yarns and at least one weft 1 yarn; the warp yarns alternately move upward and downward, thereby forming upper and lower layers; the weft 1 yarn shuttles left and right between the upper and lower layers of the warp yarns, thereby forming the braid edges by interweaving with the warp yarns; either of the left and right edges of the braid includes at least four warp yarns, referred to as Warp A, B, C, D from left to right; the right edge of the braid is provided with a right side yarn 2. The weaving processes include:

First Fore-and-Back Trip (in Conjunction with FIGS. 3, 4):

The fore trip of the weft 1 at the left edge: Warp A, B, D move downward, the weft 1 shuttles over Warp A, B, D from left to right, and, Warp C moves upward, the weft 1 shuttles under Warp C from left to right and then reach the right edge, and in the fore trip of the weft 1 at the left edge, Warp A and the weft 1 interweave and lock with each other at Warp A (see FIG. 1);

The fore trip of the weft 1 at the right edge: Warp A, B, D move downward, the weft 1 shuttles over Warp A, B, D from left to right, and, Warp C moves upward, the weft 1 shuttles under Warp C from left to right and then lock with the right side yarn 2, and in the fore trip of the weft 1 at the right edge, Warp A and the weft 1 interweave and lock with each other at Warp A (see FIG. 1); The back trip of the weft 1: the weft 1 returns along the way of the fore trip, and in the process of the weft 1 return, Warp A, B, C, D remain motionless, and the tissue form formed by the first fore-and-back trip is referred to as three-sinking-one-floating (see FIGS. 1, 2).

Figure 1:
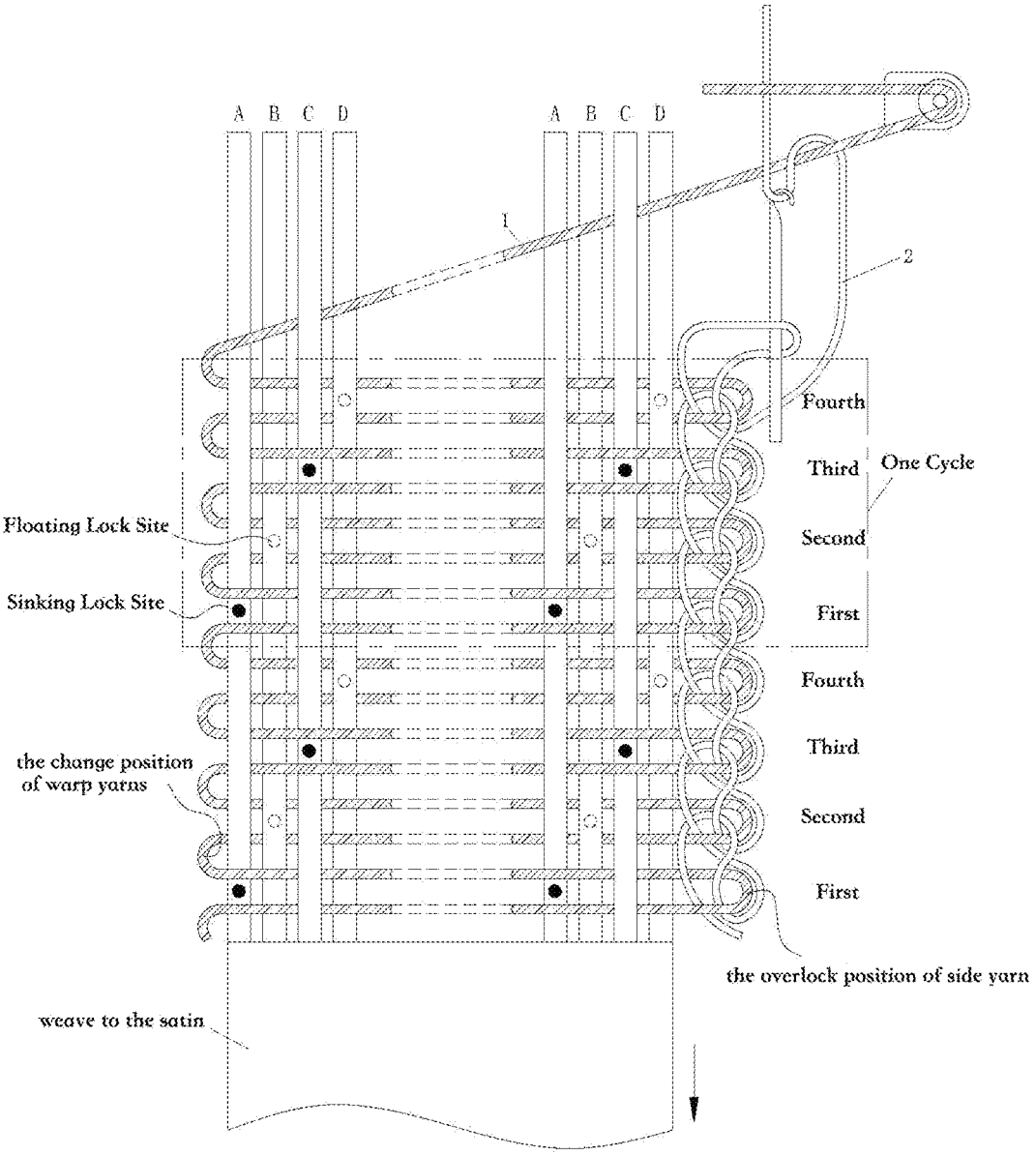
FIG. 1 is a schematic diagram of the weaving process of two side edges of the braid in the present application.
Figure 2:
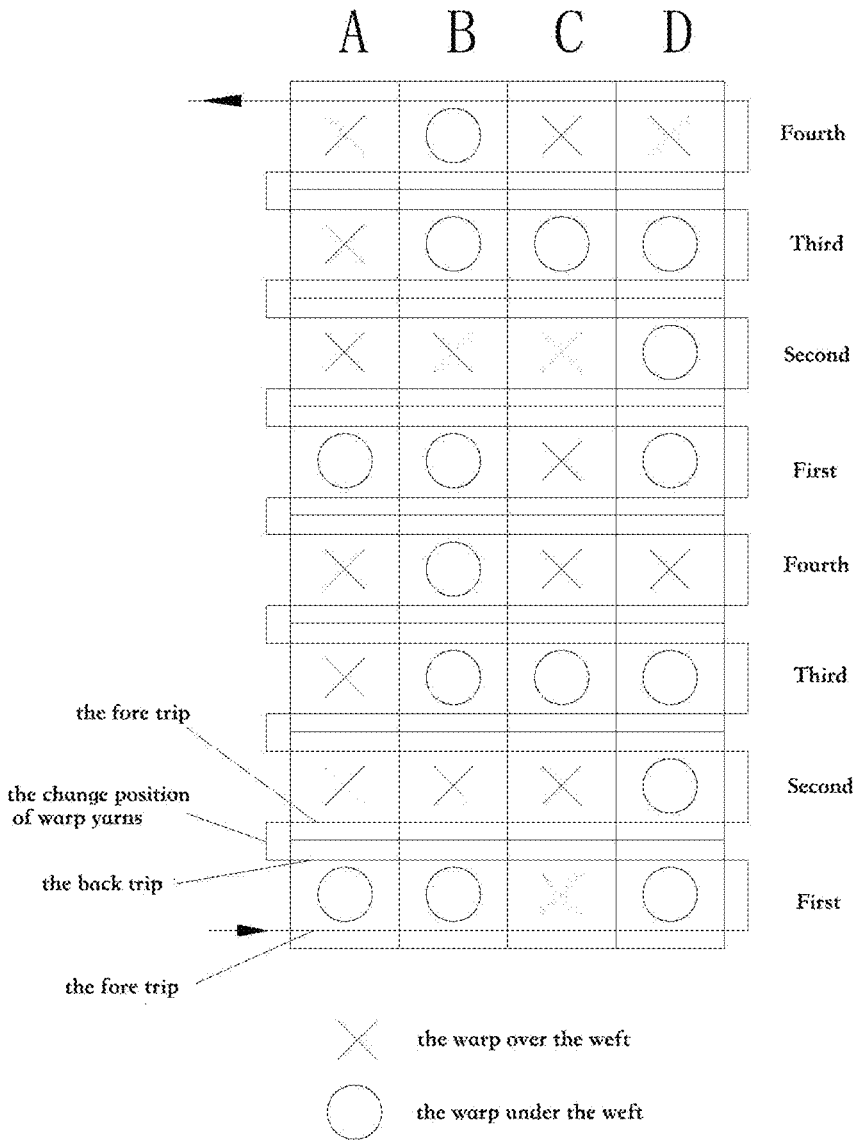
FIG. 2 is a schematic diagram of the tissue form corresponding to the left edge of FIG. 1.
Figure 3:
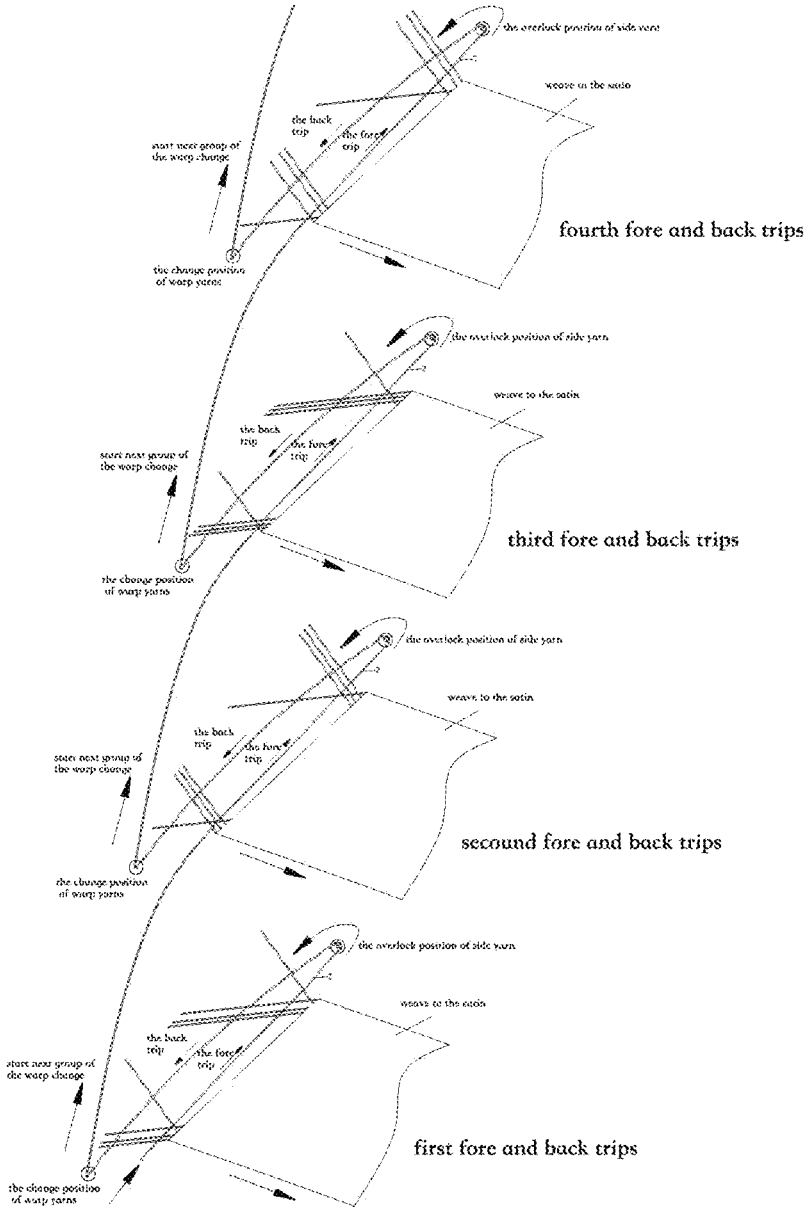
FIG. 3 is a schematic diagram of four fore-and-back trip processes of two side edges of the braid in the present application.
Figure 4:
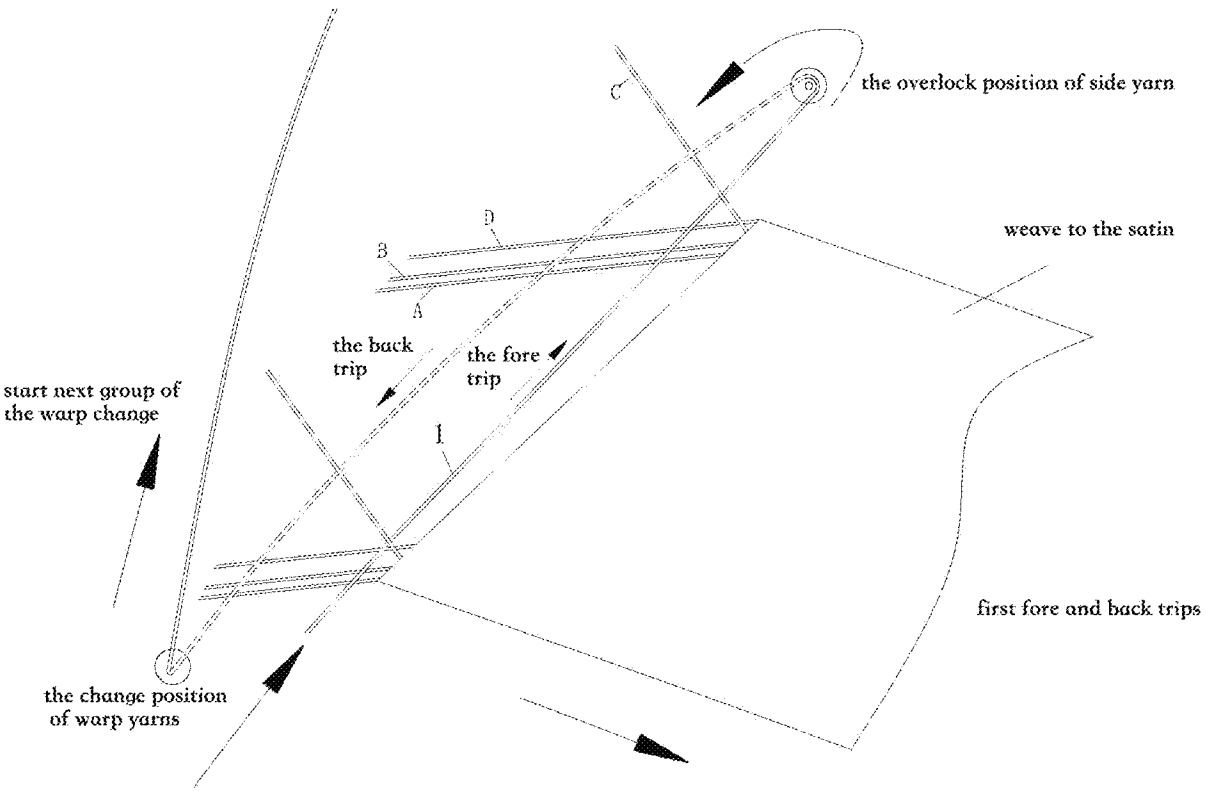
FIG. 4 is a schematic diagram of the first fore-and-back trip of FIG. 3.
Figure 5:
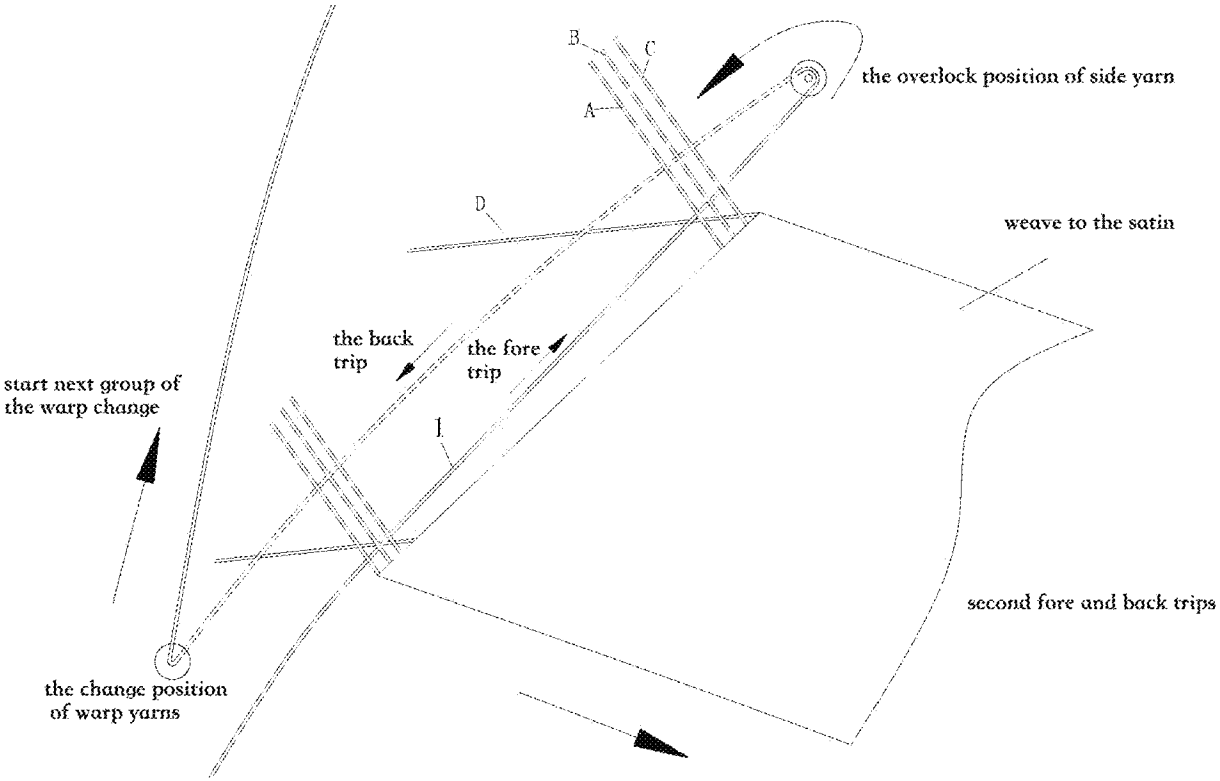
FIG. 5 is a schematic diagram of the second fore-and-back trip of FIG. 3.
Figure 6:
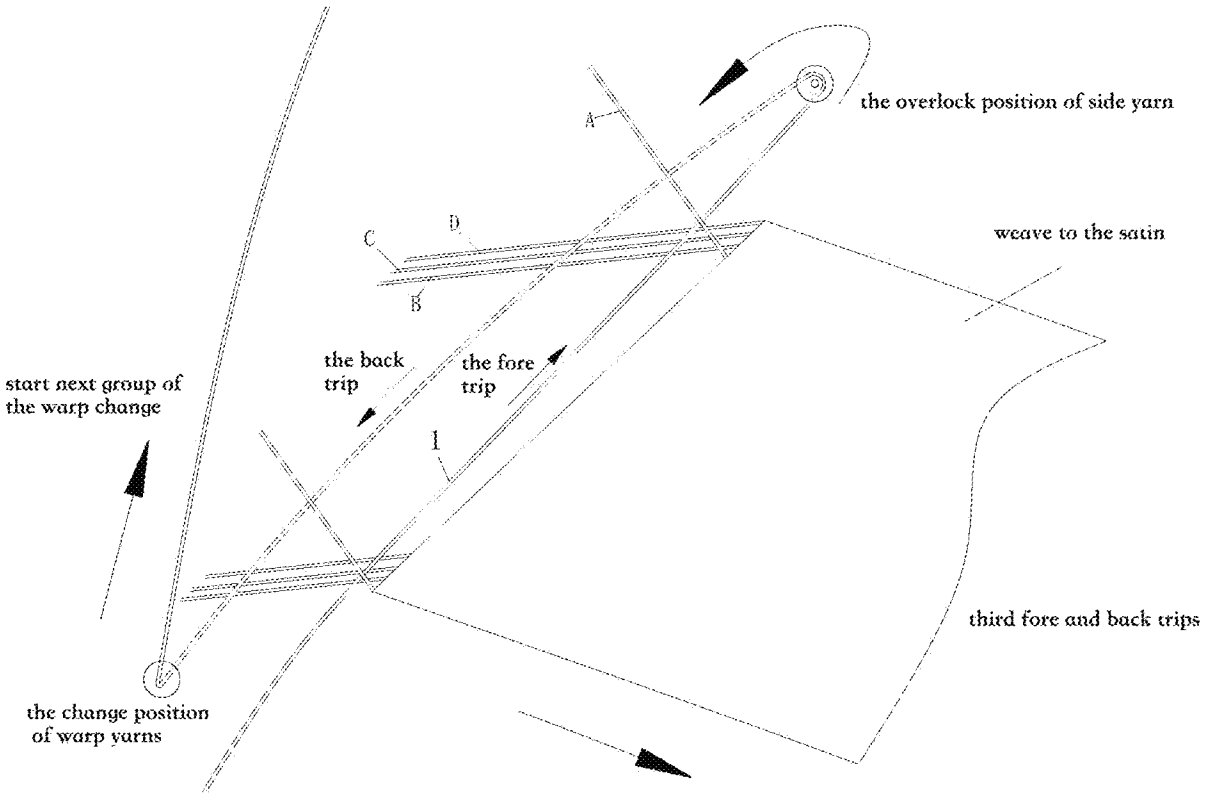
FIG. 6 is a schematic diagram of the third fore-and-back trip of FIG. 3.
Figure 7:
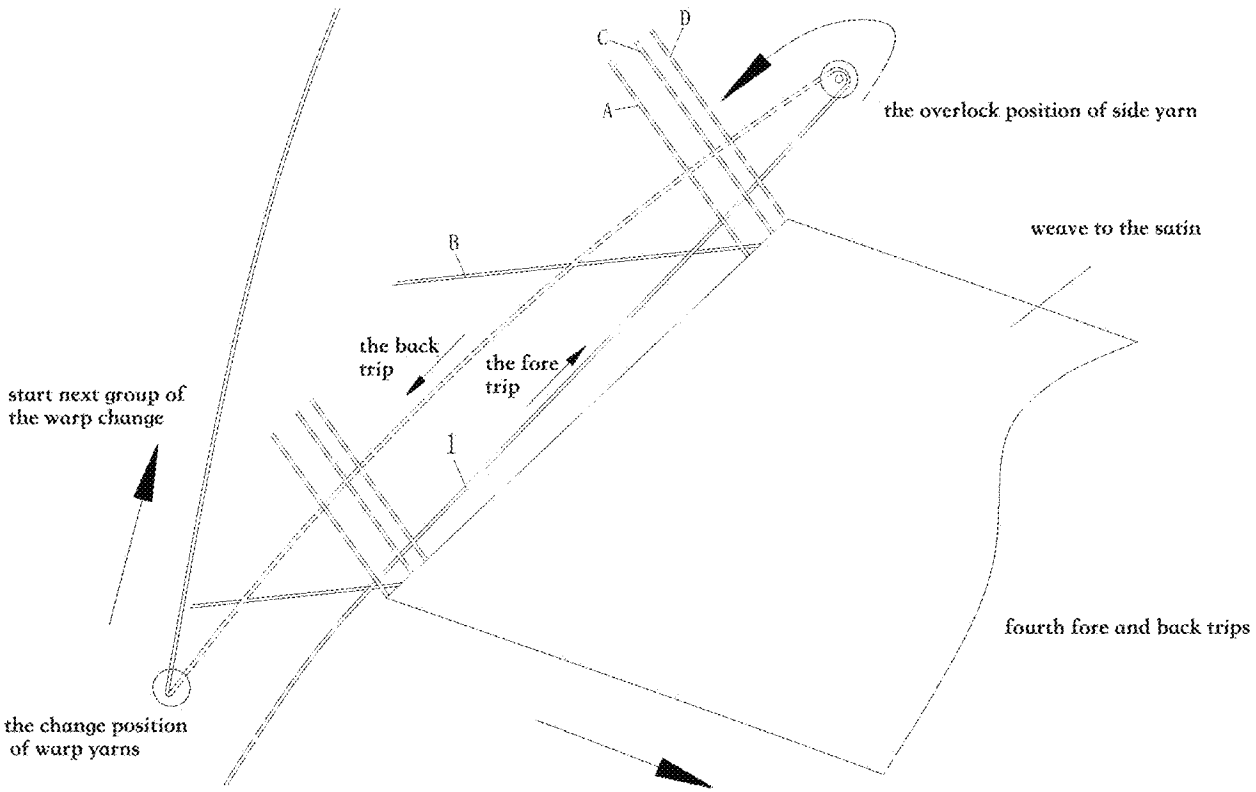
FIG. 7 is a schematic diagram of the fourth fore-and-back trip of FIG. 3.
Figure 8:
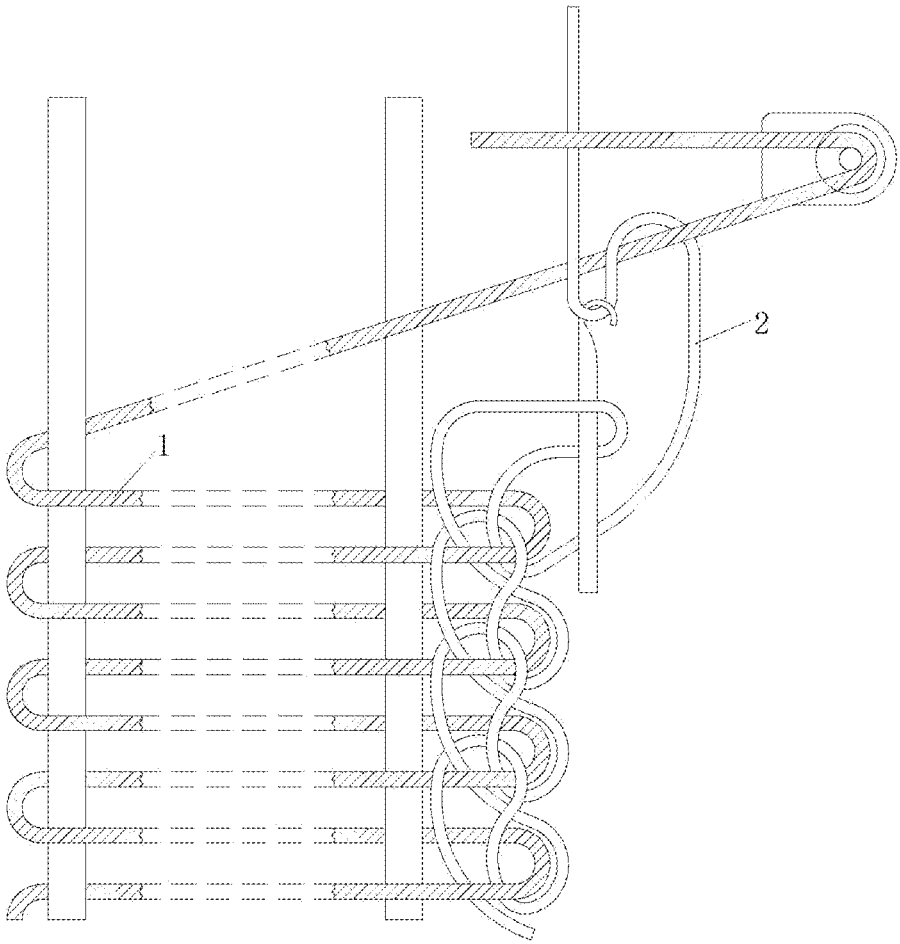
FIG. 8 is a schematic diagram of the weaving process of two side edges of the braid in the prior art.
Figure 9:
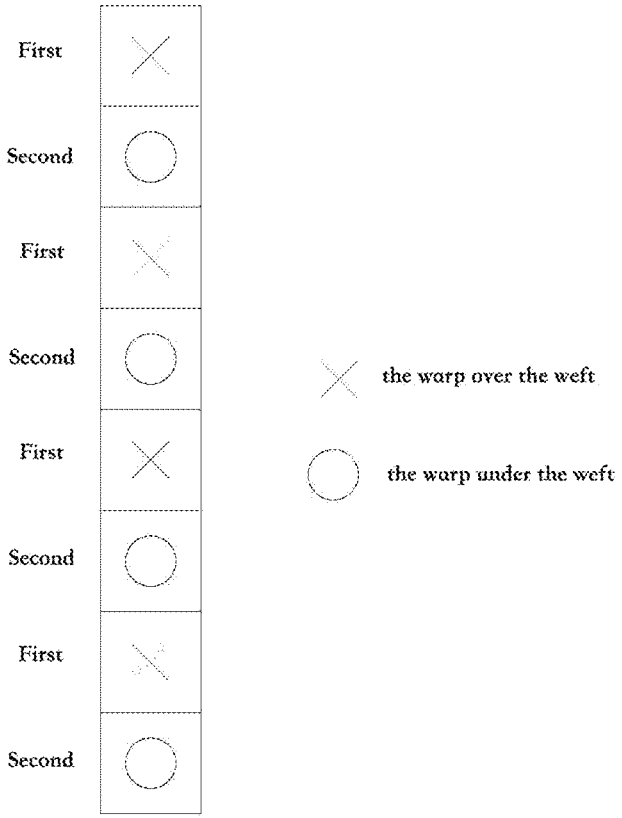
FIG. 9 is a schematic diagram of the tissue form corresponding to a single side edge in FIG. 8.

Second Fore-and-Back Trip (in Conjunction with FIGS. 3, 5):

The fore trip of the weft 1 at the left edge: Warp A, B, C move upward, the weft 1 shuttles under Warp A, B, C from left to right, and, Warp D moves downward, the weft 1 shuttles over Warp D from left to right and then reach the right edge, and in the fore trip of the weft 1 at the left edge, Warp B and the weft 1 interweave and lock with each other at Warp B (see FIG. 1); The fore trip of the weft 1 at the right edge: Warp A, B, C move upward, the weft 1 shuttles under Warp A, B, C from left to right, and, Warp D moves downward, the weft 1 shuttles over Warp D from left to right and then lock with the right side yarn 2, and in the fore trip of the weft 1 at the right edge, Warp B and the weft 1 interweave and lock with each other at Warp B (see FIG. 1);

The back trip of the weft 1: the weft 1 returns along the way of the fore trip, and in the process of the weft 1 return, Warp A, B, C, D remain motionless, and the tissue form formed by the second fore-and-back trip is referred to as three-floating-one-sinking (see FIGS. 1, 2).

Third Fore-and-Back Trip (in Conjunction with FIGS. 3, 6):

The fore trip of the weft 1 at the left edge: Warp B, C, D move downward, the weft 1 shuttles over Warp B, C, D from left to right, and, Warp A moves upward, the weft 1 shuttles under Warp A from left to right and then reach the right edge, and in the fore trip of the weft 1 at the left edge, Warp C and the weft 1 interweave and lock with each other at Warp C (see FIG. 1); The fore trip of the weft 1 at the right edge: Warp B, C, D move downward, the weft 1 shuttles over Warp B, C, D from left to right, and, Warp A moves upward, the weft 1 shuttles under Warp A from left to right and then lock with the right side yarn 2, and in the fore trip of the weft 1 at the right edge, Warp C and the weft 1 interweave and lock with each other at Warp C (see FIG. 1);

The back trip of the weft 1: the weft 1 returns along the way of the fore trip, and in the process of the weft 1 return, Warp A, B, C, D remain motionless, and the tissue form formed by the third fore-and-back trip is referred to as three-sinking-one-floating (see FIGS. 1, 2).

Fourth Fore-and-Back Trip (in Conjunction with FIGS. 3, 7):

The fore trip of the weft 1 at the left edge: Warp A, C, D move upward, the weft 1 shuttles under Warp A, C, D from left to right, and, Warp B moves downward, the weft 1 shuttles over Warp B from left to right and then reach the right edge, and in the fore trip of the weft 1 at the left edge, Warp D and the weft 1 interweave and lock with each other at Warp D (see FIG. 1);

The fore trip of the weft 1 at the right edge: Warp A, C, D move upward, the weft 1 shuttles under Warp A, C, D from left to right, and, Warp B moves downward, the weft 1 shuttles over Warp B from left to right and then lock with the right side yarn 2, and in the fore trip of the weft 1 at the right edge, Warp D and the weft 1 interweave and lock with each other at Warp D (see FIG. 1); The back trip of the weft 1: the weft 1 returns along the way of the fore trip, and in the process of the weft 1 return, Warp A, B, C, D remain motionless, and the tissue form formed by the fourth fore-and-back trip is referred to as three-floating-one-sinking (see FIGS. 1, 2);

Preferably, the Warp A, B, C, D are a group, each warp yarn is independently controlled to move upward and downward, three of Warp A, B, C, D are required to move in the opposite direction of the other one, thereby forming the upper and lower layers. A group of four warp yarns in each fore-and-back trip have only one warp yarn interweaving and locking with the weft 1 yarn, thereby forming lock sites (see FIG. 1), and the lock sites of respectively four successive fore-and-back trips locate on different warp yarns, each lock site is not at the same position, thereby forming misaligned pair lock of the upper and lower layers.

Preferably, the structure may arbitrarily select the starting point to form a four-lateral-four-longitudinal structure, but the structure is required to conform to a three-sinking-one-floating or three-floating-one-sinking form. A single side edge of the braid may include five, six, seven or more warp yarns, which may arbitrarily select the starting point to form a four-lateral-four-longitudinal structure, and the structure is required to conform to a three-sinking-one-floating or three-floating-one-sinking form.

In the above-described tissue forms, the lock sites of the structure of two side edges of the braid are shown in FIG. 1, herein the solid points are sinking lock sites and the dotted line points are the floating lock sites. By the above-described tissue forms, the structure of two side edges of the braid enables the sinking and floating of the upper and lower layers misalign properly, forming misaligned positions of warp yarns so as to make the weft 1 yarn weave pair locks.

Figure 10:
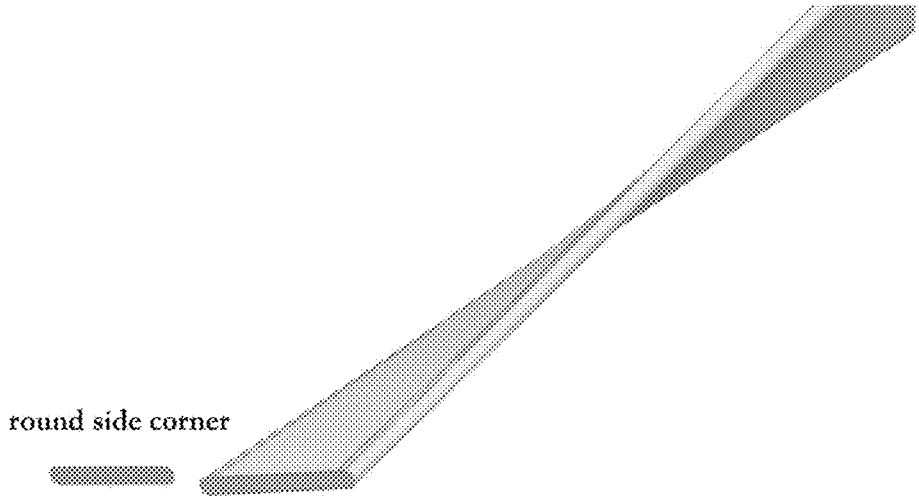
FIG. 10 is a view of the braid in the present application.

The above-described pair locks weaved by the weft 1 yarn are able to utilize the tightness of the back trip of the weft to reduce the exposure of the weft at the overlock, thereby forming elastic band with shaggy, fluffy and soft round corners at the left and right sides that are symmetrical and have no difference in shape. Thus, the structures of the left and right edges of the braid form shaggy, fluffy and soft round corners, so as to not scratch when contacting with the skins, and wear more comfortably. FIG. 10 is a view of the braid in the present application.

What is claimed is:

1. A weaving method for braid edge overlock, wherein the braid comprises a weft yarn, a right side yarn and a plurality of warp yarns; the warp yarns is alternately moving upward and downward to form a upper and lower layers and a right edge and a left edge of the braid are both formed by the weft yarn which is shuttling left side and right side between the upper and lower layers of the warp yarns, interweaving with the warp yarns, wherein either of the left and right edges of the braid comprises a warp yarn A, a warp yarn B, a warp yarn C, and a warp yarn D from left to right; and the right side yarn is provided in the right edge of the braid, characterized in that, the weaving method comprises a first fore-and-back trips, a second fore-and-back trips, a third fore-and-back trips and a fourth fore-and-back trips;

wherein the first fore-and-back trips comprises: a fore trip of the weft at the left edge, a fore trip of the weft at the right edge and a back trip of the weft yarn;

wherein the fore trip of the weft yarn at the left edge comprises:

while moving the warp yarn A, the warp yarn B, and the warp yarn D downward, shuttling the weft yarn over the warp yarn A, the warp yarn B, and the warp yarn D from left to right side, and while moving the warp yarn C upward, shuttling the weft yarn under the warp yarn C from left to right side and then reach the right edge, and making the warp yarn A and weft yarn interweave and lock with each other at the warp yarn A;

wherein the fore trip of the weft yarn at the right edge comprises:

while moving the warp yarn A, the warp yarn B, and the warp yarn D downward, shuttling the weft yarn over the warp yarn A, the warp yarn B, and the warp yarn D from left to right side, and while moving the warp yarn C upward, shuttling the weft yarn under the warp yarn C from left to right side and then locking the weft yarn with the right side yarn, and making the warp yarn A and weft yarn interweave and lock with each other at the warp yarn A;

wherein the back trip of the weft yarn:

while returning the weft yarn along the way of the fore trip of the weft yarn at the left edge and the right edge remain the warp yarn A, the warp yarn B, the warp yarn B and the warp yarn D motionless;

wherein the second fore-and-back trips comprises: a fore trip of the weft at the left edge, a fore trip of the weft at the right edge and a back trip of the weft yarn;

wherein the fore trip of the weft yarn at the left edge comprises:

while moving the warp yarn A, warp yarn B, and warp yarn C upward, shuttling the weft yarn under the warp yarn A, the warp yarn B, and the warp yarn C from left to right side, and while moving the warp yarn D downward, shuttling the weft yarn over the warp yarn D from left to right side and then reach the right edge, and making the warp yarn B and weft yarn interweave and lock with each other at the warp yarn B;

wherein the fore trip of the weft yarn at the right edge comprises:

while moving the warp yarn A, warp yarn B, and warp yarn C upward, shuttling the weft yarn under the warp yarn A, the warp yarn B, and the warp yarn C from left to right side, and while moving the warp yarn D upward, shuttling the weft yarn over the warp yarn D from left to right side and then locking the weft yarn with the right side yarn, and making the warp yarn B and weft yarn interweave and lock with each other at the warp yarn B;

wherein the back trip of the weft yarn:

while returning the weft yarn along the way of the fore trip of the weft yarn at the left edge and the right edge remain the warp yarn A, the warp yarn B, the warp yarn B and the warp yarn D motionless;

wherein the third fore-and-back trips comprises: a fore trip of the weft at the left edge, a fore trip of the weft at the right edge and a back trip of the weft yarn;

wherein the fore trip of the weft yarn at the left edge comprises:

while moving the warp yarn B, the warp yarn C, and the warp yarn D downward, shuttling the weft yarn over the warp yarn B, the warp yarn C, and the warp yarn D from left to right side, and while moving the warp yarn A upward, shuttling the weft yarn under the warp yarn A the from left to right side and then reach the right edge, and making the warp yarn C and weft yarn interweave and lock with each other at the warp yarn C;

wherein the fore trip of the weft yarn at the right edge comprises:

while moving the warp yarn B, warp yarn C, and warp yarn D downward, shuttling the weft yarn over the warp yarn B, the warp yarn C, and the warp yarn D from left to right side, and while moving the warp yarn A upward, shuttling the weft yarn under the warp yarn A from left to right side and then locking the weft yarn with the right side yarn, and making the warp yarn C and weft yarn interweave and lock with each other at the warp yarn C;

wherein the back trip of the weft yarn:

while returning the weft yarn along the way of the fore trip of the weft yarn at the left edge and the right edge remain the warp yarn A, the warp yarn B, the warp yarn B and the warp yarn D motionless;

wherein the fourth fore-and-back trips comprises: a fore trip of the weft at the left edge, a fore trip of the weft at the right edge and a back trip of the weft yarn;

wherein the fore trip of the weft yarn at the left edge comprises:

while moving the warp yarn A, the warp yarn C, and the warp yarn D upward, shuttling the weft yarn under the warp yarn A, the warp yarn C, and the warp yarn D from left to right side, and while moving the warp yarn B downward, shuttling the weft yarn over the warp yarn B from left to right side and then reach the right edge, and making the warp yarn D and weft yarn interweave and lock with each other at the warp yarn D;

wherein the fore trip of the weft yarn at the right edge comprises:

while moving the warp yarn A, warp yarn C, and warp yarn D upward, shuttling the weft yarn under the warp yarn A, warp yarn C, and warp yarn D from left to right side, and while moving the warp yarn B downward, shuttling the weft yarn over the warp yarn B from left to right side and then locking the weft yarn with the right side yarn, and making the warp yarn D and weft yarn interweave and lock with each other at the warp yarn D;

wherein the back trip of the weft yarn:

while returning the weft yarn along the way of the fore trip of the weft yarn at the left edge remain the warp yarn A, the warp yarn B, the warp yarn B and the warp yarn D motionless.

2. A braid producing by the weaving method according to claim 1, comprising: a weft yarn, a right side yarn and a plurality of warp yarns interweaving with the weft yarn;

wherein either of a left edge and a right edge of the braid comprises a warp group consist of a warp yarn A, a warp yarn B, a warp yarn C, and a warp yarn D from left side to right side; and the right side yarn is provided in the right edge of the braid;

wherein for each warp group, the warp yarn A, the warp yarn B, the warp yarn C and the warp yarn D are independently controlled to move upward and downward, three of the warp yarn A, the warp yarn B, the warp yarn C and the warp yarn D are moved in the opposite direction of the other one to form an upper layer and a lower layer;

wherein the weft yarn is shuttling left side and right side between the upper layer and the lower layer; and the weft yarn is only interweaving and locking with one warp yarn, for each warp group, to form a lock site;

wherein the lock sites of respectively four successive fore-and-back trips is located on different warp yarns, and each lock site is not at the same position, such that the upper layer and the lower layers is misaligned pair locking.

* * * * *